United States Patent [19]

Fairgrieve et al.

[11] Patent Number: 4,901,954

[45] Date of Patent: Feb. 20, 1990

[54] EAVESTROUGH HANGER

[75] Inventors: Donald F. Fairgrieve, Islington; Vince J. McGowan, Thornton, both of Canada

[73] Assignee: GSW Inc., Barrie, Canada

[21] Appl. No.: 230,420

[22] Filed: Aug. 10, 1988

[51] Int. Cl.[4] ..... E04D 13/06

[52] U.S. Cl. ..... 248/48.2; 52/11; 52/95

[58] Field of Search ..... 248/48.1, 48.2; 52/11, 52/12, 95, 96

[56] References Cited

U.S. PATENT DOCUMENTS

| | | | |
|---|---|---|---|
| 2,536,704 | 1/1951 | Shea et al. | 248/48.2 |
| 3,809,347 | 5/1974 | Pekarek | 248/48.1 |
| 3,826,048 | 7/1974 | Merkin et al. | 52/11 |
| 3,874,131 | 4/1975 | Webster | 52/11 |
| 4,060,905 | 12/1977 | Light | 248/544 X |
| 4,169,570 | 10/1979 | Morin | 248/48.2 |
| 4,345,731 | 8/1982 | Rowe | 248/48.2 |
| 4,553,356 | 11/1985 | Pepper | 52/12 X |
| 4,553,357 | 11/1985 | Pepper | 248/48.1 X |
| 4,581,857 | 4/1986 | Harbom | 52/11 X |
| 4,632,342 | 12/1986 | Skinner | 248/48.2 |

*Primary Examiner*—David L. Talbott

[57] ABSTRACT

An eavestrough system comprises a particular eavestrough section having inwardly directed locking flanges adjacent opposed upper edges thereof. This eavestrough section is designed to cooperate with a hidden hook having a cored base portion which cooperates with a cantilevered arm whick supports the eavestrough at the free end thereof. A downwardly opening locking slot is provided at the junction of the arm and base.

15 Claims, 2 Drawing Sheets

EAVESTROUGH HANGER

FIELD OF THE INVENTION

The present invention relates to eavestroughing systems and, particularly, eavestrouoghing systems where the hooks for hanging of the eavestrough are hidden.

A number of eavestrough systems are now known which use what is referred to as a hidden hook for suspending of the eavestrough below the roof eave. Examples of such systems can be appreciated from the following references: U.S. Pat. No. 4,581,857, U.S. Pat. No. 4,632,342 and U.S. Pat. No. 3,022,029.

An eavestrough system is also known according to U.S. Pat. No. 4,257,716 and U.S. Pat. No. 4,553,356 which use an eavestrough of an outer configuration similar to that disclosed in the present application, however, the eavestrough of these patents use a hook which is designed to be placed about the exterior of the eavestrough.

The following Canadian patents also disclose prior art eavestroughing systems: 1,194,672, 1,071,377, 834,590 and 956,775.

SUMMARY OF THE INVENTION

An eavestrough, according to the present invention, is of an extruded plastic and comprises a generally symmetrical cross section with a flat base having outwardly angled walls either side of the base with a vertical section secured to each outwardly angled wall at the upper edge of these walls. The vertical section to each side of the eavestrough includes inwardly directed locking flanges below an upper edge of the vertical section. Each flange at a free end thereof includes one part of a two-part locking arrangement by means of which the eavestrough may be suspended.

According to an aspect of the invention, the eavestrough includes a downwardly directed lip forming one part of the locking arrangement on each locking flange which are used to assist in locking of the eavestrough in a suitable eavestrough hanger.

According to a further aspect of the invention, the flange and the associated vertical section cooperate to provide an 'L' shaped ledge about the flange. This 'L' shaped flange is used to provide an abutment like support for receiving an eavestrough accessory or one edge of an eavestrough accessory, such as a leaf guard.

According to yet a further aspect of the invention, the eavestrough is fully symmetrical either side of the base and can be installed in either orientation.

An eavestrough hanger, according to the present invention, comprises a cored base and a forwardly extending cantilevered arm extending from the base. The arm is of an inverted 'T' shape in cross section and includes a front opening locking slot at a free end of the arm. An opposite opening slot is provided at the lower edge of the arm spaced from, but adjacent the base. The base and the arm join at a flange perpendicular to the inverted 'T' shaped section and generally centered thereon. This flange closes the inverted 'T' section at one end of the arm and is used to assist in securing of the arm to the base.

According to an aspect of the invention, the hanger includes a rectangular extension joining the flange and the base.

According to a further aspect of the invention, the eavestrough hanger is adapted with the base extending above the inverted 'T' shaped section and including in this extension portion a securing port therein for fastening of the hanger.

According to a further aspect of the invention, the eavestrough hanger is adapted by including a forwardly opening slot in the base, across the base intermediate the inverted 'T' shaped section and the securing port.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
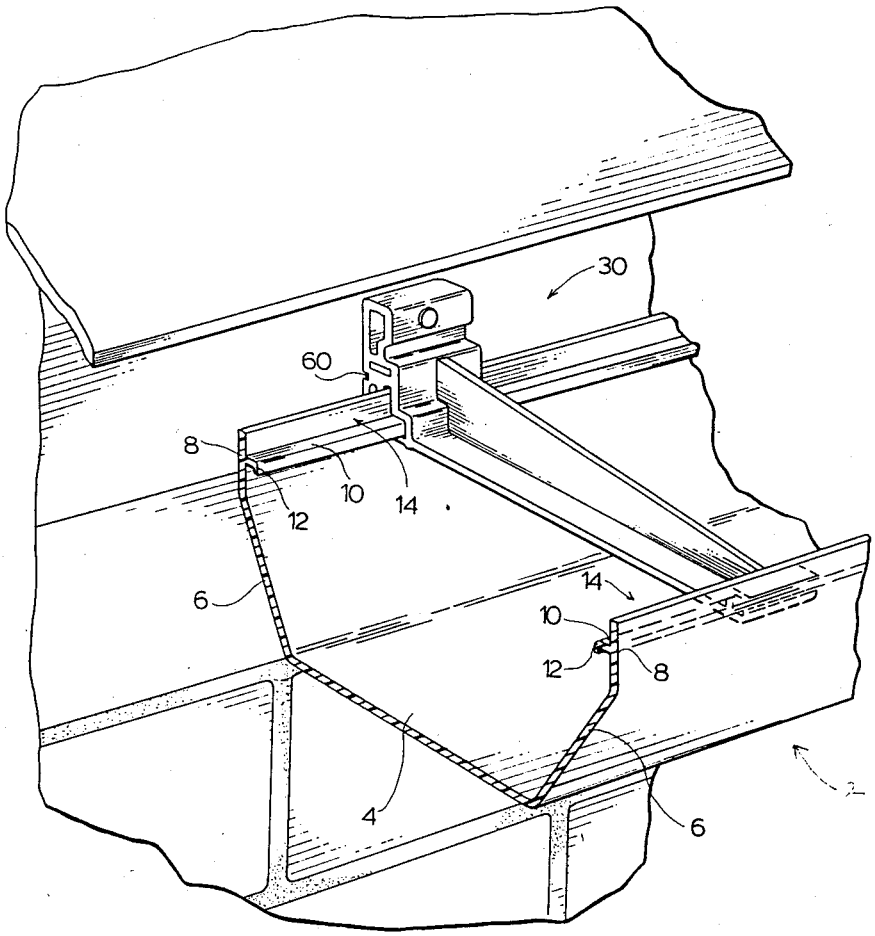
FIG. 1 is a partial perspective view showing one hanger and a portion of a building to which the hanger and eavestrough have been secured.
Figure 2:
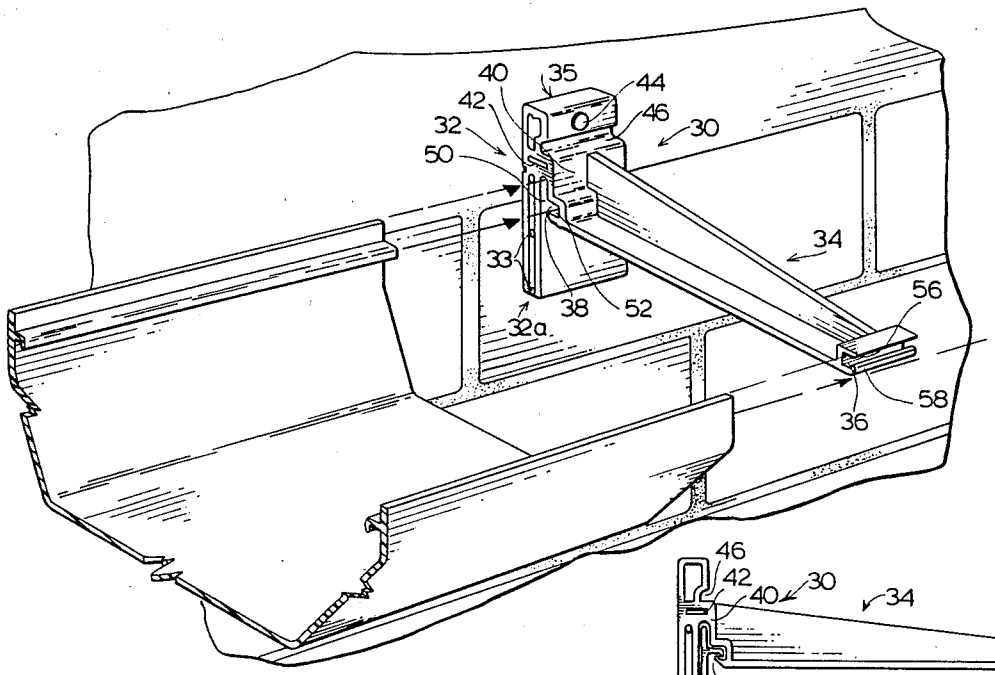
FIG. 2 is a partial perspective view illustrating how the eavestrough section can slide within a hanger.

The eavestrough section 2 is preferably of a symmetrical section having a generally flat base 4 and outwardly angled walls 6, each of which terminate in a short vertical section 8. The vertical sections 8 each include a locking flange 10 having a downwardly directed lip 12 at the free end of the locking flange. This downwardly directed lip will cooperate with the locking slots provided in the eavestrough hanger. Above the upper surface of each locking flange 10 and the inside wall of the associated vertical section 8, is an 'L' shaped ledge 14. This ledge can be used for restraining one side of a leaf guard while also serving to further hide the hook.

Figure 3:
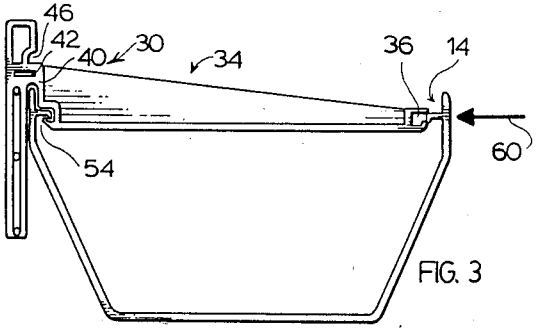
FIG. 3 is a side view showing the securement of the eavestrough section in the eavestrough hanger.

The eavestrough hanger 30 has a cored base 32 which is essentially a rectangular box with certain interior partitions and open at the sides. The hanger 30 includes a forwardly extending cantilevered arm 34 of an inverted 'T' shaped section. This arm 34 at the free end thereof includes a front opening slot 36 for receiving one of the locking flanges 10 by means of which the eavestrough is partially hung below the eavestrough hanger 30. Front opening slot 36 includes an angled camming surface 56 and a lip 58 sized to provide an interference fit with the locking flange 10 and the downwardly directed lip 12. This type of interference fit is shown in FIG. 3 and the eavestrough section may be forced as indicated by arrow 60 into the front opening slot 36. There is a similar jam type fit provided at the opposite opening slot 38 provided at the lower edge of the arm 34, but spaced from the base 32. Again, the eavestrough is forced through a slot, in this case through slot 38, such that the vertical section extends into the upwardly extending portion 50 of slot 38, which is eventually limited by the rectangular section 42 with the appropriate locking flange located in the horizontal extending portion 52 of slot 38. This horizontal extending portion 52 includes a lip 54 at the entrance thereof to provide a lock with the cooperating lip 12 of the locking flange 10. These parts coopeate to provide a two-part interference locking arrangement.

The front opening locking slot 36 and the opposite opening slot 38 are sized to allow free movement of the eavestrough section within the slots to accommodate longitudinal expansion of the eavestrough section, however, the eavestrough is firmly locked withineach slot due to the cooperation of the locking flanges 10 and slots 36 and 38.

The cored base 32 extends above the cantilevered arm 34 and defines in an upper region a securing port 44 through which a screw may be inserted to effect securement of the eavestrough hanger. The hanger also includes alignment recesses 60 provided at the rear surface of the base which are used in properly placing the eavestrough hanger the required distance below the eave of the roof. For example, a line could be drawn on the fascia board, with this line appropriately sloped according to the requirements, and then the eavestrough hangers are located on the fascia board with the aid of alignment recesses 60 being placed on that line. In this way, each of the hangers will ensure that the eavestrough is properly sloped to drain in a predetermined manner.

Both the eavestrough 2 and the eavestrough hanger 30 are made of a suitable ultraviolet stabilized plastic material, as is known in the art.

The particular eavestrough hanger 30, and the manner of coring the same, ensures there are minimal problems due to shrinkage of material during cooling of the hanger after the injection molding thereof. The various cavities are interconnected by partitions to add structural integrity and each of the cavities terminate generally at a vertical plane through the base, centered on the base, such that there is a solid core of plastic extending from the rear of the base into the forwardly extending arm and therebelow. This vertical reinforcing adjacent the arm increases the strength of the hanger. The forwardly extending cantilevered arm 34 terminates at the flange 40 which is generally perpendicular to the 'T' shaped section of arm 34. This flange is the same size as the base and stiffens the arm and provides effective load transfer between the arm 34 and the forwardly extending rectangular section 42. This forwardly extending section 42 is cored, however, rather than being vertically cored, it is cored in a generally horizontal manner to increase the structural strength thereof.

The cored base 32 of the eavestrough hanger 30 has a lower elongate box-like section **32*a* with a number of reinforcing partitions 33 extending therethrough. This elongate box-like section increases the stiffness of this lower base portion and thus stiffens the relationship between the lower portion of the forwardingly extending arm and the base. The cored box-like area 35 provided above the forwardly extending rectangular section 42 also provides additional stiffening and this stiffening is reinforced by the bushing about the securing port 44**. By coring of the base to provide a backwall and a forward wall, interconnected by a central partition running generally vertically and various horizontal partititions, less material is required and the configuration provides additional strength.

In molding of hangers of this type, there is difficulty in just adding more material, as after molding, shrinkage can cause distortion and flaws in the hanger. Thus, by coring the hanger in the manner described and configuring it, the benefits in reduction of material are achieved while still providing a rigid configuration. Also, the molding of this article allows various configurations to be used, for example, the forwardly extending section 42 is perpendicular to the cored lower elongate box-like section **32*a* while the material is integral as the product has been molded. This overlapping relationship of the various cored areas results in a strong base portion which also allows effective connection of the forwardly extending cantilevered arm 34** with the base.

When load is applied to the hanger by the eavestrough, it is opposed by the screw which is passed through securing port 44 and it is also opposed by the lower elongate box-like section 32a which will contact the facia and distribute the load thereto. As can be appreciated, the hanger or the forces on the hanger will tend to be downwardly directed causing a moment generally about the facia board and this is partially opposed by the reaction force acting on lower elongate box-like section **32*a*. Therefore, this section must be stiff but also the connection of this section to the upper cored area 35** must also be stiff. Similarly, it is important that the connection of the arm to the base is as stiff as possible to avoid flexing of the structure.

The strength of the arm is further improved by the flange 40 which is in a stepped wall configuration to partially define a locking slot while also connecting the lower flange of the forwardly extending cantilevered arm 34. In effect, the base is of a cellular type structure which not only allows convenient molding thereof, but also positions the material of the base in a configuration to improve the structural integrity of the base while allowing effective connection of the forwardly extending cantilevered arm to the base by means of the forwardly extending rectangular bridge section 42. Thus, the present design recognizes the need to not only limit the material used in the hanger, but to position this material in a manner to avoid problems often caused by shrinkage during cooling of the product after molding while effectively positioning the material to improve the strength of the resulting structure.

The eavestroughing system, according to the present invention, uses a force fit of the eavestrough section into the hanger, avoiding problems which can occur when spring deformation is associated with the locking. Plastic typically creeps during heat and a spring bias type arrangement for locking does not provide the same structural strength as a locking interfit, where problems associated with creep are reduced. Furthermore, this positive locking of the eavestrough within the eavestrough hanger avoids problems which can occur due to improper loading such as by placing a ladder on the eavestrough section. Such a load would tend to increase the securement of the locking flange within the forwardly opening slot 36 while the slot provides some support against buckling. The vertical section of the wall also strikes the end of the arm and further distributes the load.

An eavestrough under normal operating conditions is not subject to particularly high loads, however, it is subject to extreme temperature ranges from the coldest day in winter to the hottest day in summer and is also subject to ice loads and must at least withstand these loads which can greatly exceed the actual volume of the eavestrough.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A one piece plastic eavestrough hanger for supporting an eavestrough comprising a cored base and a forwardly extending cantilevered arm extending from said base, said arm being of an inverted 'T' shape in cross section and including a front opening locking slot at a free end thereof and an opposite opening slot at a lower edge of said arm spaced from, but adjacent said base, said base and said arm joining at a flange perpendicular to said inverted 'T' shaped section and generally centered thereon and closing said inverted 'T' section at one end of said arm, said cored base being generally of a box-like configuration with a plurality of interior partitions, said box-like configuration being open at the sides with a number of said partitions visible at the open sides, and wherein said base, at the point of junction of said base and said flange, has two spaced members which are generally at right angles to said flange and which join the arm and the base, said two spaced members cooperating to provide sufficient rigidity between said base and said arm without relying on such eavestrough for support; such that deflelction of said arm relative to said base during normal use in an eavestrough system is not significant.

2. An eavestrough hanger as claimed in claim 1 including a cored rectangular extension joining said flange and said base with said cored extension being open at either side of said eavestrough hanger.

3. An eavestrough hanger as claimed in claim 2 wherein said base extends above said inverted 'T' shaped section and includes a securing port therein for fastening of said hanger.

4. An eavestrough hanger as claimed in claim 3 wherein said base includes a forwardly opening slot across said base intermediate said inverted 'T' shaped section and said securing port.

5. An eavestrough hanger as claimed in claim 4 wherein said opposite opening slot has an upwardly extending portion limited by said rectangular extension and a horizontal extending portion projecting into said arm.

6. An eavestrough hanger as claimed in claim 4 including alignment marks either side of said base and below said port used in locating said hanger.

7. A plastic eavestrough hanger for supporting an eavestrough comprising a base and a forwardly extending arm connected to said base, said arm having at an end remote said base a recess for engagement with an eavestrough, said arm having a lower flange extending the length thereof with a central gusset intermediate said arm integral with said lower flange and extending the length of said arm, said gusset and said flange being secured adjacent said base by a stepped wall portion which cooperates with said base for defining an eavestrough engaging slot therebetween, said gusset and said step wall merging with an elongate cored box-like extension of said base with said cored box-like extension open at either side of said gusset, said cored box-like extension including an integral central partition which forms an extension of said gusset, said base below said extension comprising a box-like extension open at the sides and including a central partition extending the length of said extension, said base above said arm including a cellular attachment structure with a central port above said gusset by means of which said hanger is securable to a facia board, and wherein said base, at the point of junction of said base and said flange, has two spaced members which are generally at right angles to said flange and which join the arm and the base, said two spaced members cooperating to provide sufficient rigidity between said base and said arm without relying on such eavestrough for support such that deflection of said arm relative to said base during normal use in an eavestrough system is not significant.

8. A plastic eavestrough hanger as claimed in claim 7 wherein said cellular attachment structure is an open sided configuration with an integral bushing about said central port.

9. A plastic eavestrough hanger as claimed in claim 8 wherein said flange and said base are of the same width.

10. In an eavestroughing system, a plastic eavestrough hanger and a length of extruded plastic eavestroughing; said eavestroughing comprising a generally symmetrical cross section with a generally flat base having outwardly angled walls either side of said base with a vertical section secured to each outwardly angled wall, each vertical section including inwardly directed locking flanges below an upper edge of said vertical section, each locking flange at a free end thereof including one part of a two-part locking arrangement; said plastic eavestroughing hanger comprising a cored base and a forwardly extending cantilevered arm extending from said base, said arm being of an inverted 'T' shape in crosos section and including a front opening locking slot at a free end thereof and an opposite opening slot at a lower edge of said arm spaced from, but adjacent said base, said base and said arm joining at a flange perpendicular to said inverted 'T' shaped section and generally centered thereon and closing said inverted 'T' section at one end of said arm; said front opening locking slot and said opposite opening slot each including the second part of said two part locking system whereby the locking flanges are received in said front opening locking slot and said opposite opening slot to support said eavestroughing by said locking flanges when received in appropriately aligned and supported eavestrough hangers, and wherein said base, at the point of junction of said base and said flange, has two spaced members which are generally at right angles to said flange and which join the arm and the base, said two spaced members cooperating to provide sufficient rigidity between said base and said arm without relying on said eavestroughing for support such that deflection of said arm relative to said base during normal use in an eavestrough system is not significant.

11. In an eavestroughing system as claimed in claim 10, wherein said one part of said two-part locking arrangement includes a downwardly directed lip.

12. In an eavestroughing system as claimed in claim 11, wherein each flange and the associated vertical section cooperate to provide an 'L' shaped ledge above the flange.

13. In an eavestroughing sytem as claimed in claim 12, wherein said hanger includes a rectangular extension joining said flange and said base, said base extending above said inverted 'T' shaped section and including a securing port therein for fastening of said hanger.

14. In an eavestroughing system as claimed in claim 13, wherein said base of said hanger includes a forwardly opening slot across said base intermediate said inverted 'T' shaped section and said securing port, and wherein said opposite opening slot has an upwardly extending portion limited by said rectangular extension and a horizontal extending portion projecting into said arm.

15. In an eavestroughing system as claimed in claim 14, wherein said hanger includes alignment marks either side of said base and below said port used in locating said hanger.

* * * * *